US010762803B2

(12) United States Patent
Gantt

(10) Patent No.: US 10,762,803 B2
(45) Date of Patent: Sep. 1, 2020

(54) REMOVABLE LABEL FOR DOSAGE TRACKING

(71) Applicant: Leeanna Gantt, Pasadena, CA (US)

(72) Inventor: Leeanna Gantt, Pasadena, CA (US)

( * ) Notice: Subject to any disclaimer, the term of this patent is extended or adjusted under 35 U.S.C. 154(b) by 0 days.

(21) Appl. No.: 16/690,826

(22) Filed: Nov. 21, 2019

(65) Prior Publication Data

US 2020/0160756 A1 May 21, 2020

Related U.S. Application Data

(60) Provisional application No. 62/770,586, filed on Nov. 21, 2018.

(51) Int. Cl.

| | |
|---|---|
| ***G09F 3/02*** | (2006.01) |
| ***G09F 3/00*** | (2006.01) |
| ***G09F 3/10*** | (2006.01) |
| ***A61J 1/03*** | (2006.01) |

(52) U.S. Cl.

CPC ..... *G09F 3/0288* (2013.01); *A61J 1/03* (2013.01); *G09F 3/10* (2013.01); *A61J 2205/30* (2013.01); *G09F 2003/0202* (2013.01); *G09F 2003/0208* (2013.01); *G09F 2003/0222* (2013.01); *G09F 2003/0241* (2013.01); *G09F 2003/0267* (2013.01); *G09F 2003/0269* (2013.01); *G09F 2003/0273* (2013.01)

(58) Field of Classification Search

CPC ..... G09F 3/0288; G09F 2003/0272; G09F 2003/0273; G09F 3/10; G09F 2003/0202; G09F 2003/0208; G09F 2003/0222; G09F 2003/0241; G09F 2003/0267; G09F 2003/0269; A61J 2205/30

See application file for complete search history.

(56) References Cited

U.S. PATENT DOCUMENTS

| | | | | |
|---|---|---|---|---|
| 2,833,064 | A * | 5/1958 | Parker | A61J 7/04 40/312 |
| 3,896,246 | A * | 7/1975 | Brady, Jr. | G09F 3/10 428/42.2 |
| 4,752,087 | A | 6/1988 | Weisbach | |
| 5,881,597 | A * | 3/1999 | Brooks | A47G 23/16 73/428 |
| 6,293,403 | B1 | 9/2001 | Holmberg | |
| 6,649,007 | B1 | 11/2003 | Key | |
| 2002/0129758 | A1 | 9/2002 | Hanley et al. | |
| 2003/0025320 | A1 | 2/2003 | Shoemaker | |
| 2003/0222045 | A1 | 12/2003 | Shane | |
| 2006/0097516 | A1 | 5/2006 | Kozlowski et al. | |

(Continued)

FOREIGN PATENT DOCUMENTS

EP 0283064 A1 9/1988

*Primary Examiner* — Gary C Hoge

(74) *Attorney, Agent, or Firm* — Venable LLP; Michele V. Frank

(57) ABSTRACT

A reminder system in the form of a removable label. The label is configured to allow a consumer to monitor consumption of a medication and/or supplement. The label has a re-adherable adhesive backing and perforated tear off tabs. In one step, the consumer may tear off the tab for the dosage that is taken so that the next time the consumer views the bottle, the consumer is aware that the dose has been taken and what dose is to be taken next. The label is tailored to the predetermined prescription schedule.

26 Claims, 10 Drawing Sheets

(56) References Cited

U.S. PATENT DOCUMENTS

| | | | | |
|---|---|---|---|---|
| 2006/0197336 | A1* | 9/2006 | Londino | A61J 7/04 283/81 |
| 2008/0010874 | A1* | 1/2008 | Londino | A61J 7/04 40/310 |
| 2008/0116284 | A1* | 5/2008 | Gordon | G09F 3/0288 235/487 |
| 2008/0237177 | A1 | 10/2008 | Robinson | |
| 2011/0220713 | A1 | 9/2011 | Cloninger | |
| 2013/0072894 | A1* | 3/2013 | Langley | A61M 5/24 604/404 |
| 2016/0176159 | A1* | 6/2016 | Dickerson | B32B 7/06 428/40.1 |
| 2016/0232820 | A1* | 8/2016 | Koltchine | G09F 3/10 |

* cited by examiner

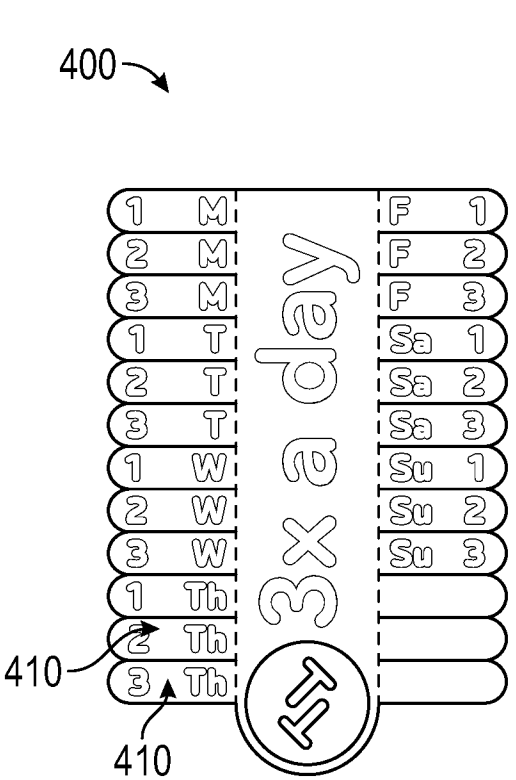
FIG. 4
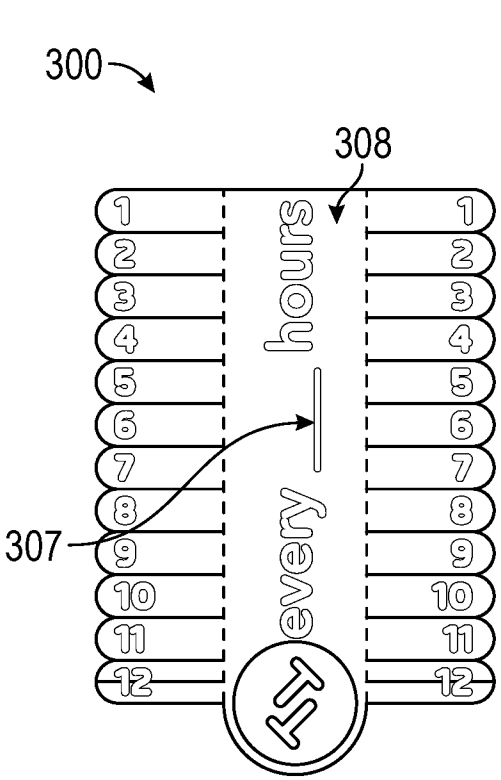
FIG. 5
FIG. 6

" I need to take this for up to 10 days"

"I need to take this every day."

"When did I take this?"

600A

600B

600C

REMOVABLE LABEL FOR DOSAGE TRACKING

CROSS-REFERENCE TO RELATED APPLICATIONS

This application claims priority to U.S. Application No. 62/770,586 filed Nov. 21, 2018, the contents of which are hereby incorporated by reference in their entirety.

TECHNICAL FIELD

The present application relates to a removable label, in particular, a removable label for dosage tracking, including, tracking dosage of the contents of a container to which the removable label can be applied.

BACKGROUND

Currently, over-the-counter medication, vitamin supplements, or other prescribed medication by a physician or medical professional have a required or recommended dosage schedule. In some cases, as with a vitamin supplement, it is not critical, but beneficial, to take the recommended dosage each day. In other cases, such as with antibiotics, pain medication, or blood pressure medication, it is critical to the medication as prescribed. Often times, patients, caregivers, or consumers forget or have difficulty remembering to take each scheduled dosage. This may be especially true when there are multiple medications, each on a different dosage schedule. Additionally, when a medication and/or supplement has been taken for an extended period of time, it may be difficult to remember on which day the medication was taken since it has become so routine to take the medication. Thus it is easy for the consumer to not take a vital prescription for fear they have already taken it or may take too much medicine as they are unsure if they have taken the dose. Thus, a need exists for a simple, yet effective reminder system to assist a consumer in tracking scheduled dosages.

BRIEF SUMMARY

According to an embodiment, a single-layer, removable label may include a main body having a central longitudinal axis; at least one first tab on a first side of the central longitudinal axis; at least one second tab on a second side of the central longitudinal axis; and an adhesive applied to a rear side of the main body and a rear side of each of the at least one first tab and the at least one second tab. The first side and the second side are opposing sides of the central longitudinal axis.

According to an embodiment, the adhesive is a low-tack, pressure-sensitive adhesive.

According to an embodiment, the adhesive is applied directly to the rear side of the main body and the rear side of each of the at least one first tab and the at least one second tab.

According to an embodiment, the adhesive allows the single-layer, removable label to be removable, repositionable, reuseable, readherable, or relocatable, or combinations thereof.

According to an embodiment, the adhesive is applied to an entirety of the rear side of the main body and an entirety of the rear side of each of the at least one first tab and the at least one second tab.

According to an embodiment, the at least one first tab comprises a plurality of first tabs and the at least one second tab comprises a plurality of second tabs.

According to an embodiment, a number of the plurality of first tabs is equal to a number of the plurality of second tabs.

According to an embodiment, the plurality of first tabs and the plurality of second tabs are located along an entirety of a length of the main body.

According to an embodiment, each of the plurality of first tabs is separated from an adjacent tab of the plurality of first tabs with a first detachable connection and wherein each of the plurality of first tabs is separated from the main body with a second detachable connection.

According to an embodiment, the first detachable connection is a die cut and the second detachable connection is a perforation.

According to an embodiment, each of the plurality of second tabs is separated from an adjacent tab of the plurality of second tabs with a third detachable connection and wherein each of the plurality of second tabs is separated from the main body with a fourth detachable connection.

According to an embodiment, the first detachable connection and the third detachable connection are each a die cut.

According to an embodiment, the second detachable connection and the fourth detachable connection are each a perforation.

According to an embodiment, one or more indicators printed on a front side of the main body and the front side of each of the at least one first tab and the at least one second tab.

According to an embodiment, the one or more indicators corresponds to a predetermined dosage schedule.

According to an embodiment, the predetermined dosage schedule is 7-10 days, daily, a number of predetermined hours, or a number of predetermined times per day.

According to an embodiment, a single-layer, removable label may include a main body having a central longitudinal axis; a first subset of tabs on a first side of the central longitudinal axis, the first subset of tabs comprising a plurality of first tabs; a second subset of tabs on a second side of the central longitudinal axis, the second subset of tabs comprising a plurality of second tabs, wherein the first side is opposite the second side about the central longitudinal axis; a low-tack, pressure-sensitive adhesive applied to a rear side of the main body, a rear side of the plurality of first tabs, and a rear side of the plurality of second tabs; and one or more indicators disposed on a front side of the main body and a front side of the plurality of first tabs, and a front side of the plurality of second tabs. The plurality of first tabs are separated from the main body with a first detachable connection, the plurality of second tabs are separated from the main body with a second detachable connection, and wherein each of the plurality of first tabs are separated from adjacent tabs of the plurality of first tabs with a third detachable connection and each of the plurality of second tabs are separated from adjacent tabs of the plurality of second tabs with a fourth detachable connection.

According to an embodiment, the main body includes a rectangular portion and a semi-circular portion and wherein each of the tabs of the plurality of first tabs and the plurality of second tabs includes a rectangular portion and a rounded portion.

According to an embodiment, each of the first detachable connection and the second detachable connection are perforations and each of the third detachable connection, and the fourth detachable connection are die cut.

According to an embodiment, the low-tack, pressure-sensitive adhesive allows the single-layer, removable label to be removable, repositionable, reuseable, readherable, or relocatable, or combinations thereof and is configured to leave no residue on an exterior surface to which the single-layer, removable label is secured.

According to an embodiment, the one or more indicators are printed, embossed, or imprinted on the front side.

According to an embodiment, a single-layer, removable dosage tracking label may include a single-layer main body; and one or more single-layer tabs coupled to the single-layer main body. The single-layer, removable dosage tracking label is configured for use with a container having items with a dosage requirement, and wherein the one or more single-layer tabs corresponds to the dosage requirement.

According to an embodiment, the items with a dosage requirement are pills, tablets, medication, supplements, or vitamins.

According to an embodiment, the one or more single-layer tabs include an indicator corresponding to the dosage requirement.

According to an embodiment, the one or more single-layer tabs are configured for removal from the single-layer main body, and wherein the one or more single-layer tabs are configured to track dosage of the item in the container.

Additional features, advantages, and embodiments of the invention are set forth or apparent from consideration of the following detailed description, drawings and claims. Moreover, it is to be understood that both the foregoing summary of the invention and the following detailed description are exemplary and intended to provide further explanation without limiting the scope of the invention as claimed.

BRIEF DESCRIPTION OF DRAWINGS

The accompanying drawings, which are included to provide a further understanding of the invention and are incorporated in and constitute a part of this specification, illustrate preferred embodiments of the invention and together with the detailed description serve to explain the principles of the invention. In the drawings:

FIG. 4 shows a front view of a removable label, according to an embodiment.

FIG. 5 shows a front view of a removable label, according to an embodiment.

FIG. 6 shows a front view of a removable label, according to an embodiment.

DETAILED DESCRIPTION

Embodiments of the invention are discussed in detail below. In describing embodiments, specific terminology is employed for the sake of clarity. However, the invention is not intended to be limited to the specific terminology so selected. A person skilled in the relevant art would recognize that other equivalent parts can be employed and other methods developed without departing from the spirit and scope of the invention. All references cited herein are incorporated by reference as if each had been individually incorporated.

The present disclosure relates to a reminder system in the form of a removable label. The label assists the consumer in noting whether or not they have taken their medication or if the medication needs to be taken. The label is a simple, yet effective visual reminder for tracking dosage, including, frequency of a dose. The label has a re-adherable adhesive backing and perforated tear off tabs. The tabs help track if a consumer is taking the medication and/or supplements according to the prescribed or recommended dosage. In one simple step, the consumer may tear off the tab for the dosage that is taken so that the next time the consumer views the bottle, the consumer is aware that the dose has been taken and what dose is to be taken next. The label is placed on the original packaging so that the consumer still has access to the important information regarding the prescription, medication, and/or supplement. The label allows for anyone reading the label to quickly determine the state of the prescription. Thus, a caretaker, parent, medical professional, emergency medical professional, etc. is able to quickly see what medications that a consumer is taking and when the last dose was taken.

In one aspect, the removable label can include a single-layer, removable label with a main body and tabs extending from the main body. The single-layer, removable label may be a label comprised of only a single layer of material with an adhesive applied to a rear surface and indicators applied to a front surface. The single-layer label may provide a simple, easy to use label. The single-layer label may allow for a label with no pieces or remnants of the label remaining on a container when the label and tabs have been exhausted. The label may be removed from the container without leaving a residue and/or without leaving any label remnants on the container. The single-layer label avoids the complexities of a multi-layer label which provide confusion to a consumer regarding which dosage has been taken and which may leave other labels or layers behind on the container when a tab is removed.

Figure 1:
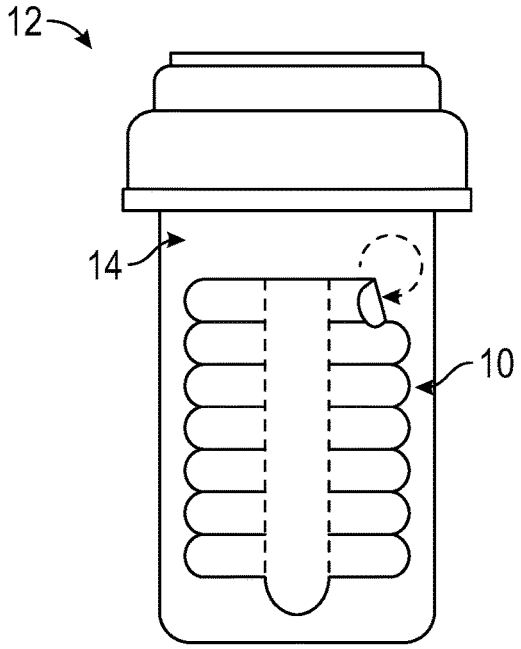
FIG. 1 shows a removable label on a container, according to an embodiment.

Referring to FIG. 1, a label 10 is shown located on a container 12. Although container 12 is shown as a medicine bottle, other containers may be contemplated. Such as, for example, a box, a pill box, a bottle, a medicine container, or other container or packaging. The label 10 may be a single layer, removable label, as will be described in more detail. The label 10 may be applied to an outer surface 14 of the container 12, although, in placement on an interior surface (such as an interior box lid), is contemplated. The label 10 may be placed at any location on the container 12. Once the label 10 is placed on the container 12, the label 10 may be moved or relocated to other locations on the container 12 or another container, either the same or different as container 12.

Figure 2:
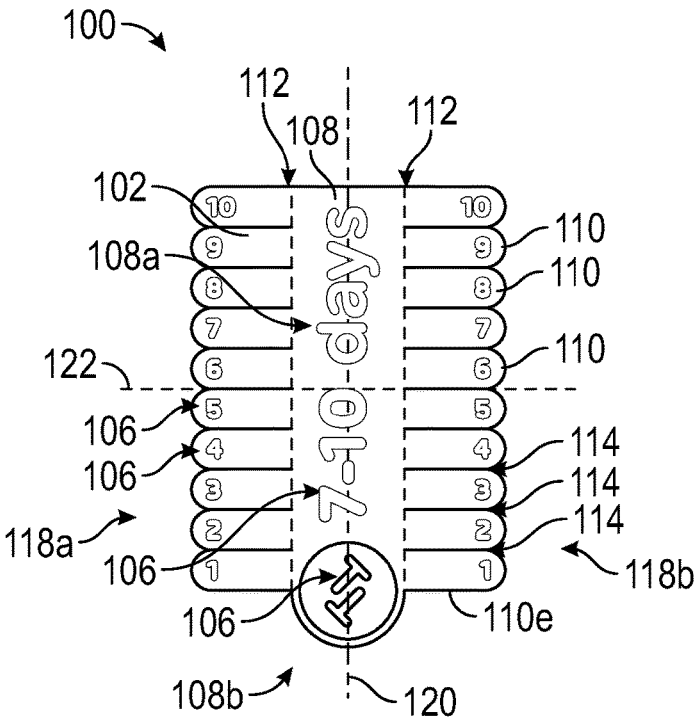
FIG. 2 shows a front view of a removable label, according to an embodiment.
Figure 3:
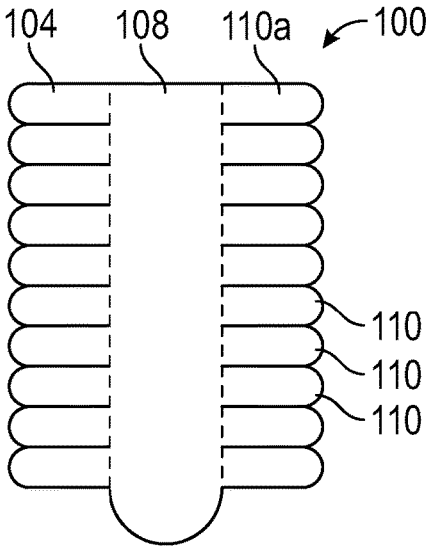
FIG. 3 shows a rear view of the removable label of FIG. 2, according to an embodiment.

Referring to FIG. 2, an exemplary label 100 is shown. The label 100 may have a front side 102 and a rear side 104 (FIG. 3). The surface of the front side 102 may be printed with one or more indicators 106. The indicators 106 may be printed directly onto the front side 102 of the label 100. The indicators 106 may be words, text, numbers, logos, dosages, etc. The surface of the front side 102 may be printed with one or more colors, or may be transparent except for the presence of any indicator(s) 106. The label 100 may have a main body 108 and one or more tabs 110. The main body 108 may be an elongated body. The main body 108 may be a rectangle, circle, square, polygon, ellipse, or other shape. As shown in FIG. 2, the main body 108 may have a rectangular portion 108*a* and a rounded or semi-circular portion 108*b*. Although the rounder or semi-circular portion 108*b* may take other shapes, such as, for example, triangular or rectangular. The portion 108*b* may extend past an edge 110*e* of a bottommost tab or tabs 110. The top edge of the portion 108*a* may be co-linear with a top edge of the uppermost tab or tabs 110. The main body 108 may have an indicator(s) 106 printed thereon. The indicator 106 printed on the main body 108 may correspond to a dosage size, a length of use of a dosage, a frequency of use of dosage, or other indication. For example, the main body 108 of label 100 indicates a length of use of a dosage of "7-10 days." That is, the dosage instructed by the medical professional that is provided in container 12 (FIG. 1) is to be taken for 7-10 days. Although described with respect to medicinal use, it may be appreciated that the label 100 and indicators 106 thereon may be employed in other methods. Although shown as 7-10 days, the length of usage of the dose may be any length, including any number of days, hours, weeks, months, etc.

The main body 108 may be a column that may be configured to separate one or more tabs 110. The main body 108 may be configured to indicate a first set of information (e.g., the dosage course, such as 7-10 days, daily, etc.) the tabs 110 may be configured to indicate a second set of information (e.g., the numbers 1-10 for the 7-10 course, the days of the week for the daily course, etc.). The first set of information may be different than the second set of information. Thus, the main body 108 may be configured to indicate different information than the tabs 110.

With continued reference to FIG. 2, the tabs 110 may be elongated. The tabs 110 may be a rectangle, circle, square, polygon, ellipse, or other shape. As shown in FIG. 2, the tabs 110 may have a rectangular portion and a rounded or semi-circular portion, although the semi-circular portion may be other shapes, such as, for example, triangular. All of the tabs 110 may have the same shape. Alternatively, subsets or subgroups of tabs 110 may have the same shape that may be different than other subsets or subgroups of tabs 110. Alternatively, any or all of the tabs 110 may be different shapes than any or all of the remaining tabs 110. Each tab 110 may be coupled, connected, joined, or otherwise attached to the main body 108. The tab 110 may be attached to the main body 108 at a connection 112. The connection 112 may be a perforation or other detachable connection. Each tab 110 may be coupled, connected, or otherwise attached to an adjacent tab 110 at a connection 114. The connection 114 may be a pre-cut portion, a die cut, perforation or other detachable connection. In an exemplary embodiment, the tabs 110 may be connected at connection 112 to the main body 108 via a perforation and the tabs 110 may be connected at connection 114 to adjacent tabs via a die cut or other preformed cut or slit.

The tabs 110 may each have an indicator(s) 106 printed thereon. The indicator 106 may correspond to the indicator 106 on the main body 108. That is, where the main body 108 indicates a length of use of the dosage of "7-10 days" as shown in FIG. 2, each tab 110 may be labeled with a number corresponding to the "7-10 days." Thus, as shown in FIG. 2, each tab 110 has the numbers 1-10 to correspond to a dosage that is to be taken for 7-10 days. As shown, there are two of each numbered tab 110 to correspond to a medicine that is to be taken twice a day for 7-10 days. However, only one of each numbered tab 110 may be provided to correspond to a medicine taken only once per day for 7-10 days.

Although the indicator(s) 106 are described as printed on the main body 108 and tabs 110, alternative forms of indicator(s) 106 may be contemplated. For example, the indicator(s) 106 may be imprinted, embossed, or otherwise formed on the main body 108 and/or tabs 110 such that impressions and/or protrusions are present on the label 100. For example, such imprinting may be braille or other symbols. The imprinting may allow for a tactile, touch of the tab 110 to indicate the dosage to be taken. Alternatively, the indicator(s) 106 may be omitted and a consumer and/or medical professional may write on the main body 108 and/or tabs 110 the desired schedule for dosage and number of each dosage as prescribed by the medical professional or as suggested by the packaging. Alternatively, the indicator(s) 106 may be applied to the label 100 in any method of printing, creating, or label-making.

FIG. 2 shows two subsets 118*a*, 118*b* of tabs 110. The first subset 118*a* may be on a first side of the main body 108 and the second subset 118*b* may be on a second side of the main body 108. The first subset 118*a* and the second subset 118*b* may be on opposing sides of a central longitudinal axis 120 of the label 100. The tabs 110 of the first subset 118*a* and the tabs 110 of the second subset 118*b* may be mirror images about the axis 120. The tabs 110 may be arranged along the length, either along a partial length or along the entire length, of the main body 108 on one or more sides of the axis 120. The first subset 118*a* and the second subset 118*b* may be arranged symmetrically about the axis 120. The label 100 may have a central horizontal axis 122. The first subset 118*a* and the second subset 118*b* may each have portions located on opposing sides of the axis 122. The tabs 110 on both sides of the axis 122 may be mirror images of each other. The tabs 110 may be arranged along the length, either along a partial length or along the entire length, of the main body 108 on one or more sides of the axis 122. The first tabs 110 may be arrange symmetrically about the axis 122.

The axes 120, 122 allow for the label 100 to be arranged or shaped in many orientations. For example, the label 100 may have a main body 108 that is circular. The circular main body may have a longitudinal and transverse axis. The tabs 110 may be arranged around the perimeter or circumference of the circular main body. Thus, the tabs 110 may be arranged symmetrically about either or both of axes 120, 122. The axes 120, 122 allow for symmetric, user-friendly operation of the label 100. Allowing for a consumer to quickly operate and quickly and easily determine the next dosage. Other symmetric and/or mirror-image designs of the label 100 may be contemplated without regard to the shape of the particular main body 108 and/or tabs 110.

Referring to FIG. 3, the rear side 104 of the label 100 is shown. An adhesive may be applied to the rear side 104 of the label 100. The adhesive may be an adhesive that allows for removal, repositioning, reuse, re-adhere, and/or relocation of the label 100 on an exterior surface, such as the outer surface 14 of the bottle or container 12 (FIG. 1). As mentioned, the label 100 may be a single layer label. Thus, the adhesive may be applied directly to the rear surface or rear side 104 of the label. The adhesive may be applied to the entirety of the rear side 104 of the label. Alternatively, the adhesive may be applied to the entirety of the main body 108, a portion of the main body 108, the entirety of the tabs 110, or a portion of the tabs 110, or a combination thereof. In an exemplary embodiment, the adhesive may be applied to the entirety of the main body 108 and to an interior portion 110*a* of each of the tabs 110. The interior portion 110*a* may be a portion of the tab 110 closer to the main body 108 than to the end of the tab 110 (e.g. the rounded end of the tab shown in FIG. 3). The interior portion 110*a* may be an interior half of the tab 110. In another exemplary embodiment, the adhesive may be applied to the entirety of the main body 108 and an entirety of each of the tabs 110.

The adhesive may be an adhesive that, when removed from the exterior surface to which it is applied, does not damage the surface and/or any other labels located on the surface. The adhesive may be an adhesive that is used in repositionable stickers. The label 100 may be a coated or uncoated paper stock with a repositionable adhesive backing. The label 100 may have a re-adherable strip or surface of glue on the rear side 104. The adhesive may allow for temporarily attaching the label 100 to other surfaces. The adhesive may be a low-tack pressure-sensitive adhesive. The adhesive may be any re-adherable glue or adhesive material. The adhesive may allow the label 100 to be easily attached, removed, and eve re-posted elsewhere without leaving a residue.

To facilitate understanding, use of the label 100 will be described with respect to a prescribed medicine located in a bottle (e.g. as shown in FIG. 1), however other containers and other uses, outside of medicine, may be contemplated. For example, the label 100 may be provided for use with medicine, vitamins, minerals, supplements, or other item that requires a reminder.

With reference to FIGS. 1 and 2, a consumer may be prescribed a medicine that is presented in a bottle, such as the container 12. The consumer may be prescribed the medicine twice a day for 7-10 days by their medical professional (e.g. as shown in the label 100 of FIG. 2). The consumer may affix the label 100 to the outer surface 14 of the container 12. When the consumer takes the first dose of the medicine on the first day, the consumer may remove a first tab 110 having an indicator 106 that is the number "1." As the tab 110 is connected to the main body 108 and the adjacent tab 110 by a perforated connection, the tab 110 with the indicator "1" may be removed from the remaining portion of the label 100 without disturbing the main body 108 and/or the remaining tabs 110. The removed tab 110 may be thrown in the garbage or otherwise disposed of. When the consumer takes the second dose of the medicine on the first day, the consumer may remove a second tab 110 having an indicator 106 that is the other number "1." The tab 110 may be disposed of. On the second day, the consumer may repeat the process for the first and second doses of the second day, but now removes the tab 110 having an indicator 106 that is the number "2." The consumer may repeat the process until all 10 days of doses are completed. At this point, only the main body 108 of the label 100 may be remaining on the container 12. If the tabs are exhausted prior to the ending of the prescription, the consumer may remove the main body 108 of the label 100 and replace with a new label 100 having a full set of tabs 110. The consumer may continue to remove the tabs 110 on the new label 100 until the prescription is complete or until the tabs 110 are exhausted and a new label is needed.

As mentioned, the main body 108 and each tab 110 may have the adhesive on the rear surface. Thus, the tabs 110 may be individually secured to the bottle or exterior surface by the adhesive. The tabs 110, being detachably connected to adjacent tabs 110, may then be peeled, individually, away from the exterior surface leaving the main body and adjacent tabs on the exterior surface.

The label 100 may be placed on the container such that the label 100 does not obscure information already present on the bottle. If the label 100 is accidently placed to obscure information desired to be read or shown, the adhesive may allow the label 100 to be removed from the bottle and relocated or re-stuck to the bottle. When the label 100 and/or any of the tabs 110 are removed, the container and/or a label on the container is exposed in its original state. The container can be returned to its original state, in part, as the tabs 110 are removed, or in whole if the label 100 is removed in its entirety.

Referring to FIGS. 4-6, exemplary labels are shown. The labels 200, 300, and 400 of FIGS. 4-6 may be the same or similar to the label 100 in all respects except for the indication of dosage and number of tabs present. Although 20 tabs are shown in label 100, 14 tabs are shown in label 200, 24 tabs are shown in label 300, and 24 tabs are shown in label 400, more or fewer tabs may be provided. For example, as previously described, half as many labels may be provided. Additionally, the labels 200, 300, and/or 400 may be used in the manner as the label 100, but tailored to the particular dosage schedule printed thereon. The various embodiments having innovative predetermined combinations of tabs and indicators configured to provide for a ready-to-use dosage tracking system and method when combined with a container in accordance with the principles of the invention. The predetermined combinations may correlate or correspond to a dosage prescribed by a medical professional or suggested by the packaging. The predetermined combinations may be any of those described here, such as, for example, a schedule of predetermined dosages per day, per week, or per month, a schedule of predetermined days, weeks, or months of dosages, etc.

Referring to FIG. 4, the label 200 is shown for daily use. In the label 200, tabs 210 are shown printed with indicators that name each day of the week. The label 200 may be used to take two doses on each day for one week (e.g. the consumer removes each tab labeled "Su" when the two doses on Sunday are taken). Alternatively, the label 200 may be used to take one dose on each day for two weeks (e.g. the consumer removes one tab labeled "Su" on the first Sunday and the second tab labeled "Su" on the subsequent Sunday).

Referring to FIG. 5, the label 300 is shown for hourly use. In the label 300, the consumer may fill in the blank on the line 307 on the main body portion 308 to indicate the prescribed hourly increments. For example, if the prescription is for use every four hours, the consumer may insert the number four on the line 307. Then, during use, the consumer may remove each numbered tab in succession every 4 hours until the dosage schedule is complete or until the tabs are all removed and a new label may be replaced on the medicinal container.

Referring to FIG. 6, the label 400 is shown for use three times a day. In this case, the tabs 410 are printed with indicators that have the numbers "1," "2," "3," and also the day of the week. Thus, the first three tabs 410 have printed a "1" and "M," a "2" and "M," and a "3" and "M." In use, the consumer may remove the "1," "2," and "3" sequentially on Monday when each dose is taken. On Tuesday, the consumer may repeat with the tabs 410 labeled with a "T." And so on, until the dosage schedule is complete or until a new label 400 is required. Although shown for use three times a day, the label 400 may be printed with any number of dosages per day, including twice a day, four times a day, five times a day, six times a day, etc.

Figure 7A:
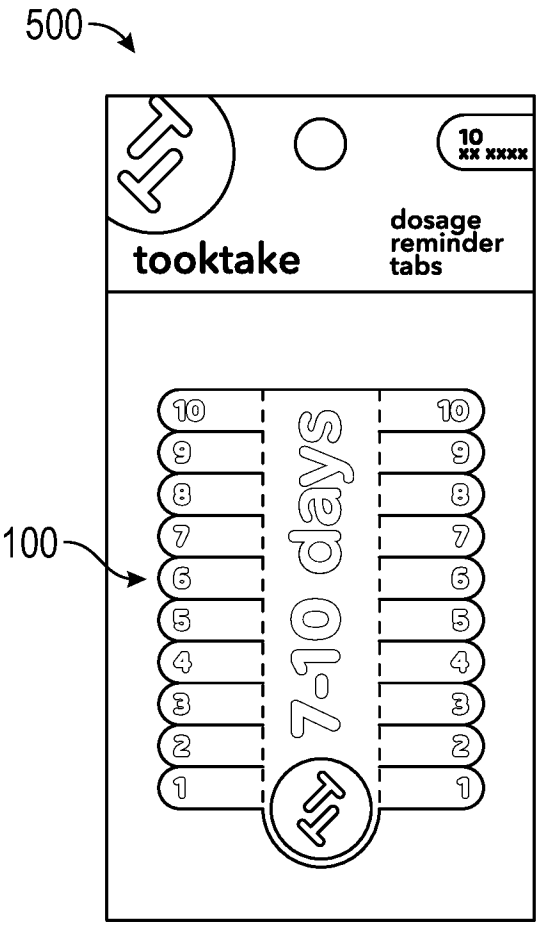
FIG. 7A shows a package including a removable label, according to an embodiment.
Figure 7B:
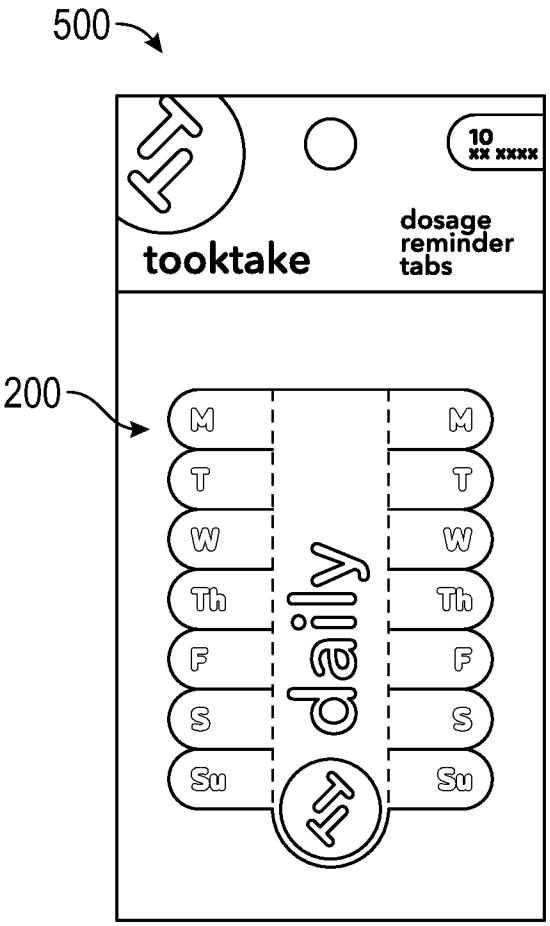
FIG. 7B shows a package including a removable label, according to an embodiment.
Figure 7C:
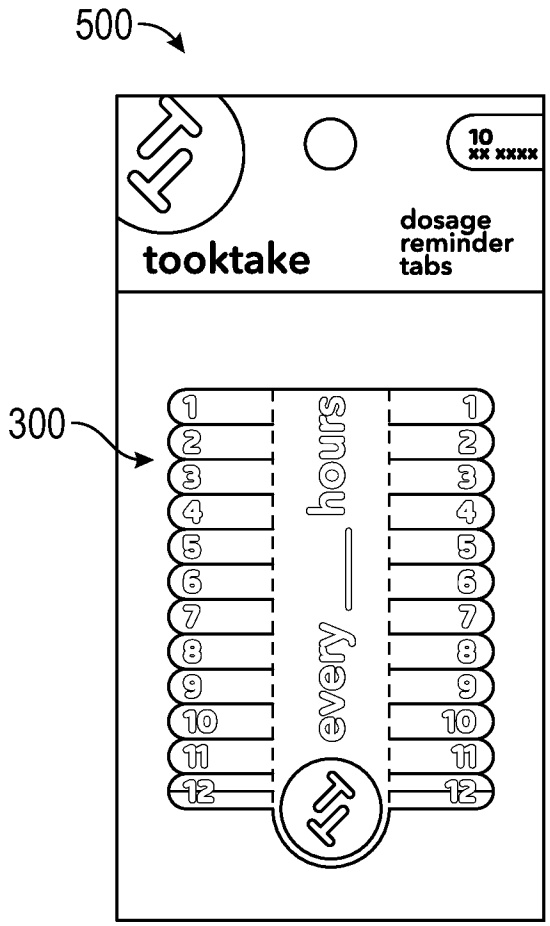
FIG. 7C shows a package including a removable label, according to an embodiment.

Although the labels 100, 200, 300, and 400 are shown directed to particular scheduled dosages, other dosage schedules or patterns may be contemplated. That is, any number of hourly, daily, monthly, set time periods, etc. (e.g. 7-10 days, 14 days, 21 days, etc.) schedules may be contemplated. Referring to FIGS. 7A-7C, the labels 100, 200, and 300 are shown in packaging 500. The packaging 500 may be easy to open. The packaging 500 may be color coded to the respective label or otherwise coordinated with the respective label to allow for easy identification of the desired label.

Figure 8A:
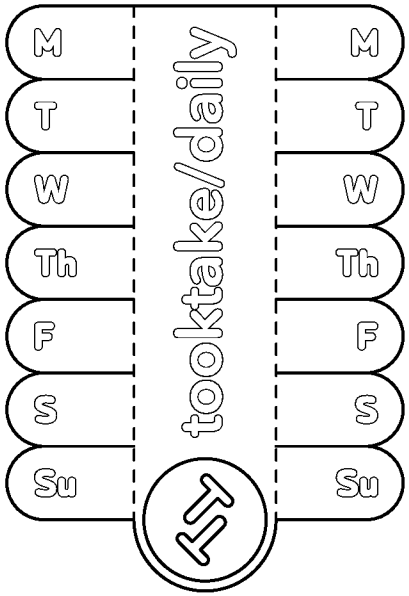
FIG. 8A shows a front view of a removable label, according to an embodiment.
Figure 8B:
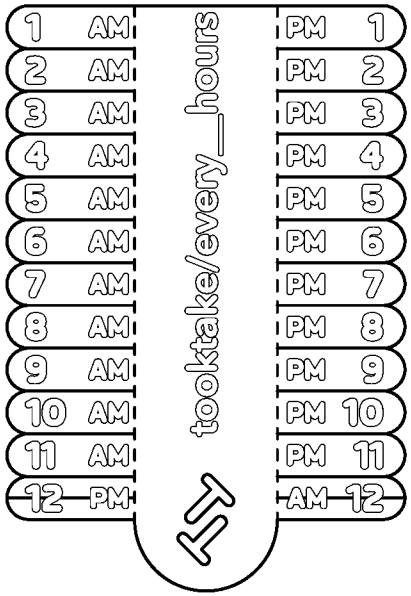
FIG. 8B shows a front view of a removable label, according to an embodiment.
Figure 8C:
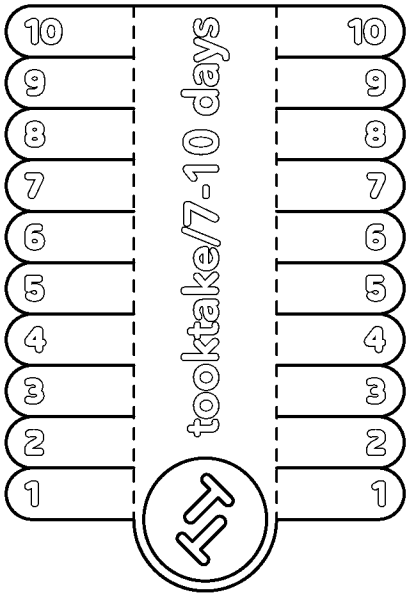
FIG. 8C shows a front view of a removable label, according to an embodiment.

Referring to FIGS. 8A-8C, alternatives to label 100 are shown. The labels 600A, 600B, 600C of FIGS. 8A-8C may be the same or similar to the labels 100, 200, 300, and/or 400 in all respects. Although 14 tabs are shown in label 600A, 24 tabs are shown in label 600B, and 20 tabs are shown in label 600C, more or fewer tabs may be provided. For example, as previously described, half as many labels may be provided. The labels may be used in the manner as any of the aforementioned the labels, tailored to the particular dosage schedule printed thereon. The various embodiments having innovative predetermined combinations of tabs and indicators configured to provide for a ready-to-use dosage tracking system and method when combined with a container in accordance with the principles of the invention. The predetermined combinations may correlate or correspond to a dosage prescribed by a medical professional or suggested by the packaging. The predetermined combinations may be any of those described here, such as, for example, a schedule of predetermined dosages per day, per week, or per month, a schedule of predetermined days, weeks, or months of dosages, etc.

Referring to FIG. 8A, the label 600A is shown for daily use, similar to the label 200. The label 600A may be used in the same or similar manner as described with respect to label 200. Referring to FIG. 8B, the label 600B is shown for hourly use. The label 600B may be used in the same or similar manner as described with respect to label 300. Referring to FIG. 8C, the label 600C is shown for daily use for 7-10 days. The label 600C may be used in the same or similar manner as described with respect to label 100. Although not shown, another label designed for use 3× a day may be provided similar to the labels 600A, 600B, and 600C.

Although the labels 600A, 600B, and 600C are shown directed to particular scheduled dosages, other dosage schedules or patterns may be contemplated. That is, any number of hourly, daily, monthly, set time periods, etc. (e.g. 7-10 days, 14 days, 21 days, etc.) schedules may be contemplated.

Figure 9C:
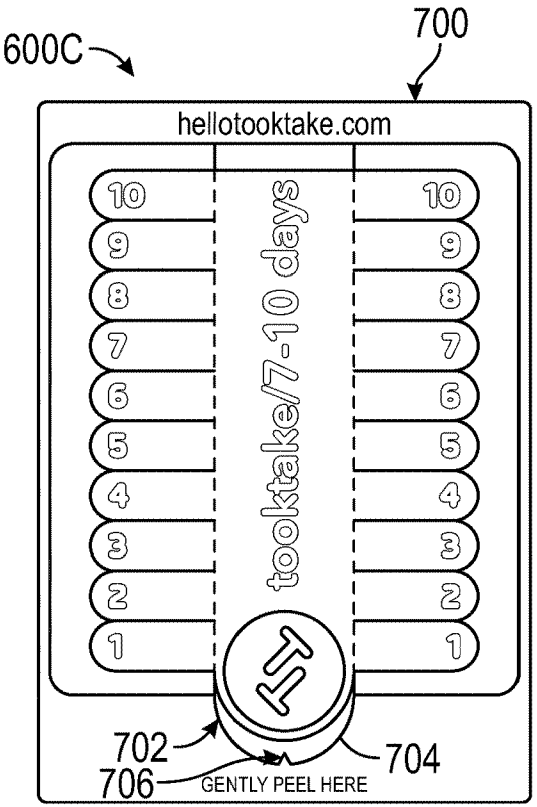
FIG. 9C shows a front view of a removable label on a backing sheet, according to an embodiment.
Figure 9B:
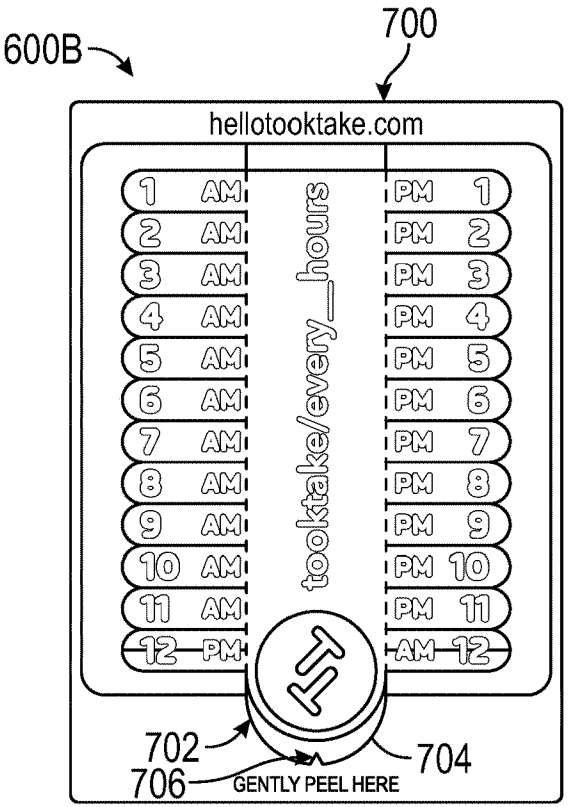
FIG. 9B shows a front view of a removable label on a backing sheet, according to an embodiment.
Figure 9A:
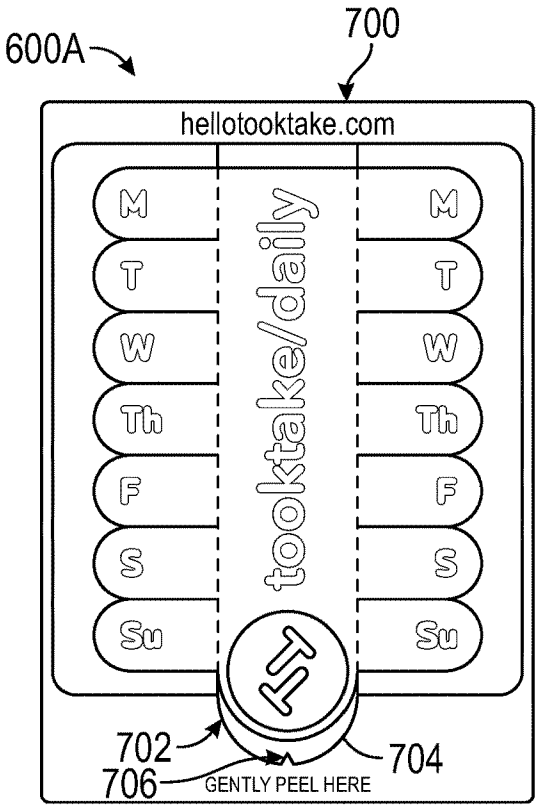
FIG. 9A shows a front view of a removable label on a backing sheet, according to an embodiment.

Referring to FIGS. 9A-9C, the labels 600A, 600B, and 600C are shown on their backing sheet 700. The labels 600A, 600B, and 600C may be removable from the backing sheet 700 for placement onto a container, such as, for example, a medicinal container. The backing sheet 700 may include an indicator 702. The indicator 702 may guide the user to the location from which the label should be peeled. For example, a user may hold the backing sheet 700 and begin peeling the label 600A starting at the location near the indicator 702. The indicator 702 of FIGS. 9A-9C may be a semi-circular image 704 with a cutout 706 therein. The cutout 706 may indicate the user to hold at the cutout 706 with one hand, while peeling the label 600A with the other hand. Although shown as a semi-circle with a triangular cutout, other shapes and indicators may be provided.

Figures 10A, 10B, 10C:
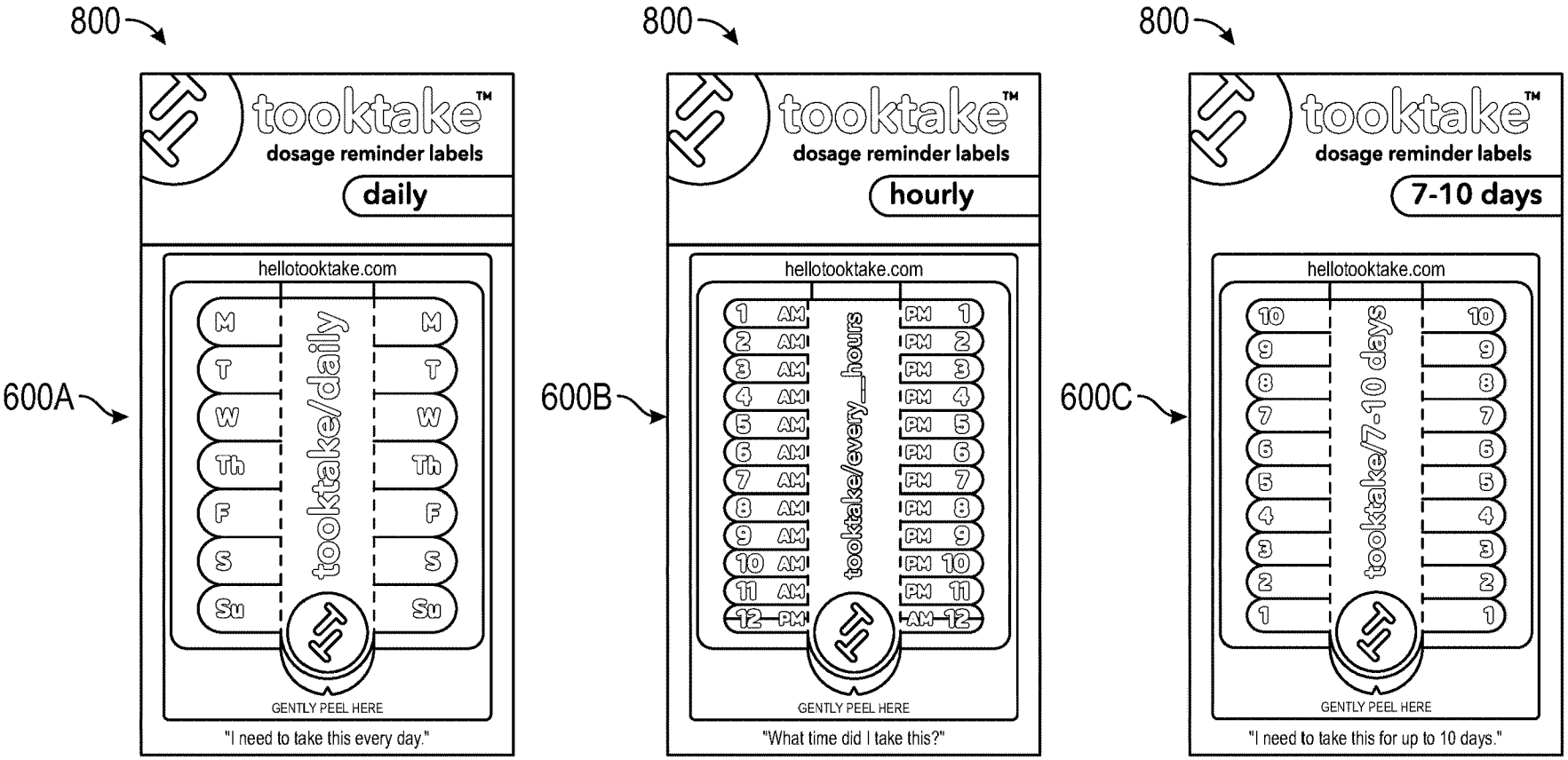
FIG. 10A shows a package including a removable label, according to an embodiment.
FIG. 10B shows a package including a removable label, according to an embodiment.
FIG. 10C shows a package including a removable label, according to an embodiment.

Referring to FIGS. 10A-10C, the labels 600A, 600B, and 600C are shown in packaging 800. The packaging 800 may be easy to open. The packaging 800 may be color coded to the respective label or otherwise coordinated with the respective label to allow for easy identification of the desired label.

Figure 11:
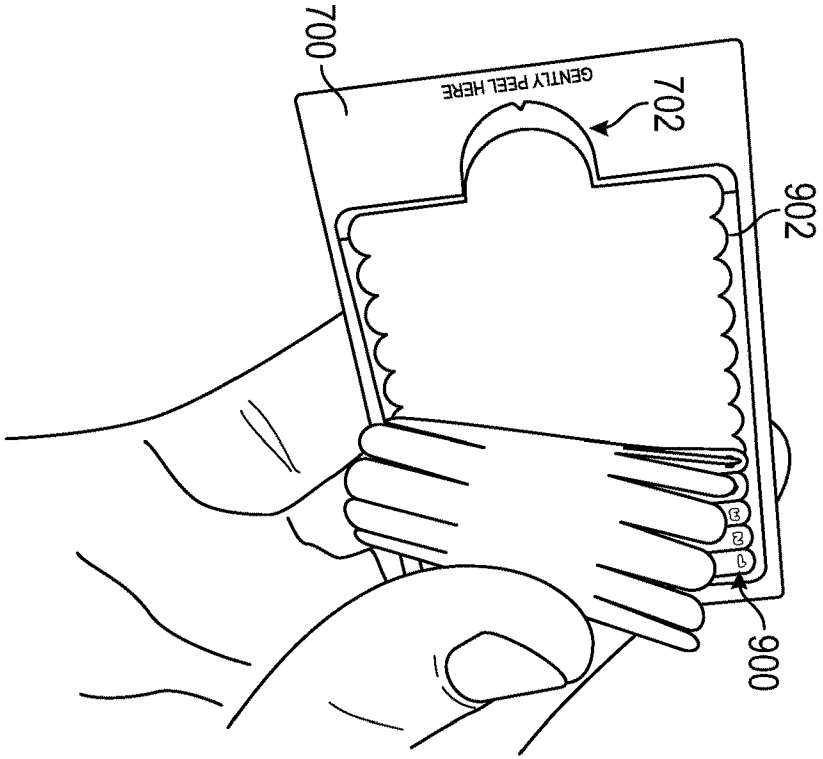
FIG. 11 shows a removable label being removed from a backing sheet, according to an embodiment.
Figure 12:
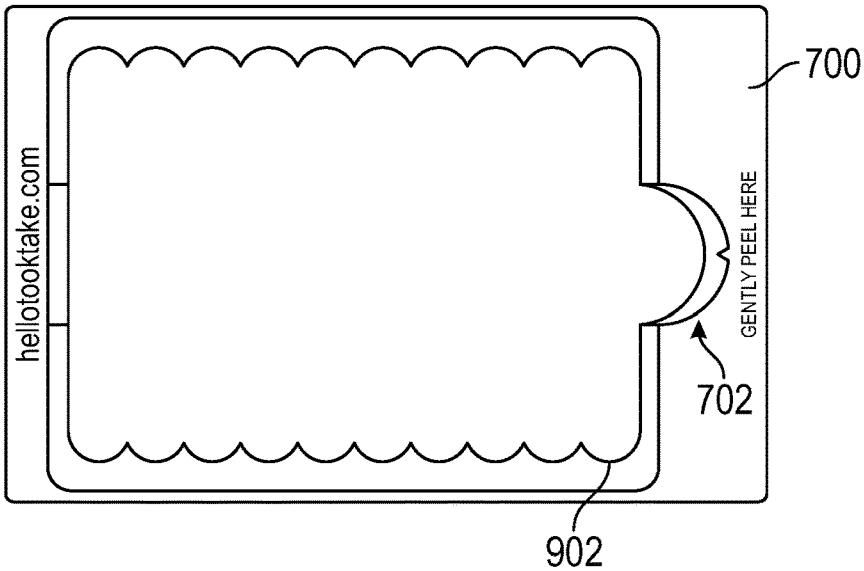
FIG. 12 shows a backing sheet without the removable label, according to an embodiment.

Referring to FIG. 11, a user is shown removing a label 900 from a backing sheet 700. The label 900 may be any of the aforementioned labels. The backing sheet 700 may include an indicator 702. The label 900 may peel from the backing sheet 700 due to a removable adhesive on a rear surface of the label 900, such as previously described, such that the label 900 may be stick to the backing sheet 700, be removed from the backing sheet 700, and be applied to a container after removal from the backing sheet 700. As shown in FIGS. 11 and 12, an outline 902 of the label may be left behind on the backing sheet 700. The outline 902 may mimic or conform to the outer perimeter of the label 900.

Figure 13A:
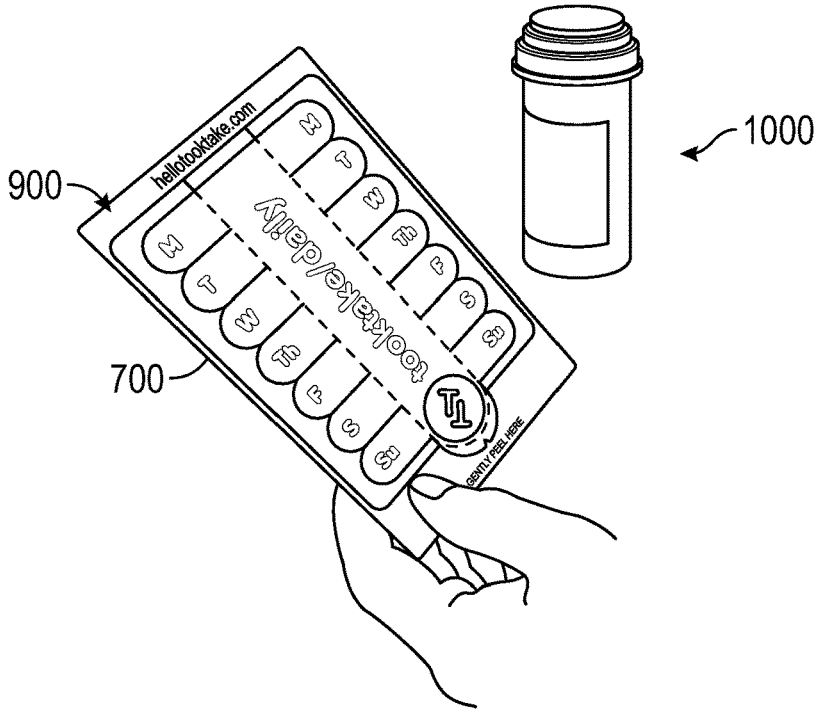
FIGS. 13A-13E show a method of using a removable label, according to an embodiment.

Referring to FIGS. 13A-13E, a method for removing a label 900 from a backing sheet 700 and applying the label 900 to a container 1000 is shown. The label 900 may be any of the aforementioned labels. The container 1000 may be any of the aforementioned containers. In FIG. 13A, a user selects the appropriate label 900 for the dosage requirement (e.g., daily, weekly, hourly, etc.). The user removes the label 900 from the packaging. The label 900 is located on a backing sheet 700 in the packaging. When the packaging is removed, the label 900 remains on the backing sheet 700.

Figure 13B:
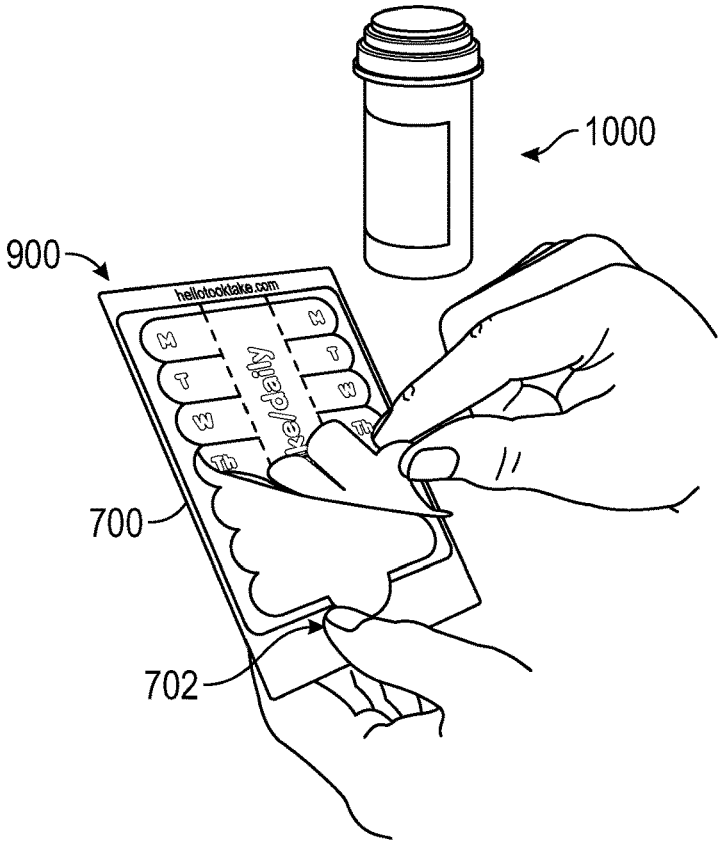
Figure 13C:
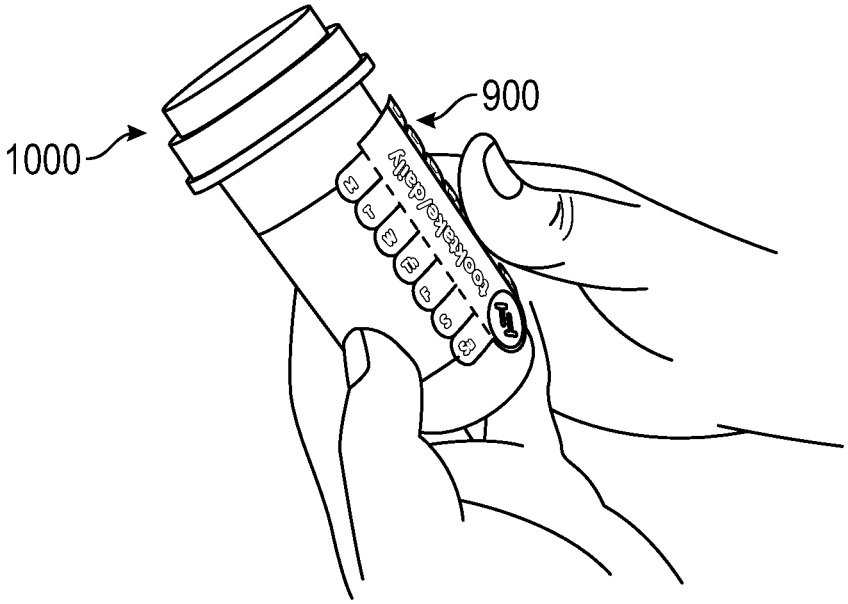

In FIG. 13B, the user holds the backing sheet 700 at the indicator 702 with a first hand. Beginning at the indicator 702, the user peels the label 900 from the backing sheet 700 until the entire label 900 is clear of the backing sheet 700. The user than applies the label 900 to a container 1000, such as a medicinal container. The user may press the label 900 firmly onto the container such that the label 900 adheres to the container 1000. The label 900 may include an adhesive on the rear surface that allows for the label to be adhered to the backing sheet 700, removed from the backing sheet 700, and adhered to a container 1000. The user may press all aspects of the label 900 firmly onto the label, including the main body and the tabs.

Figure 13D:
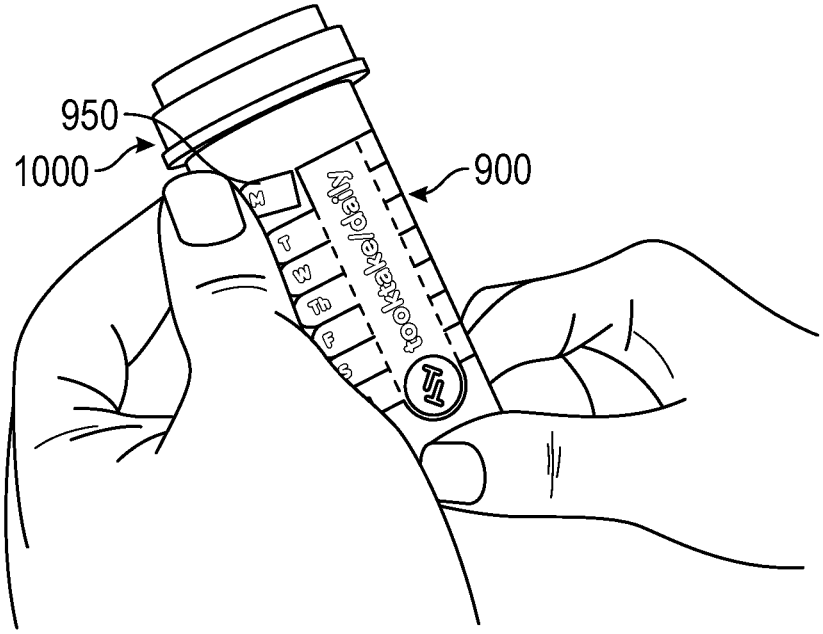
Figure 13E:
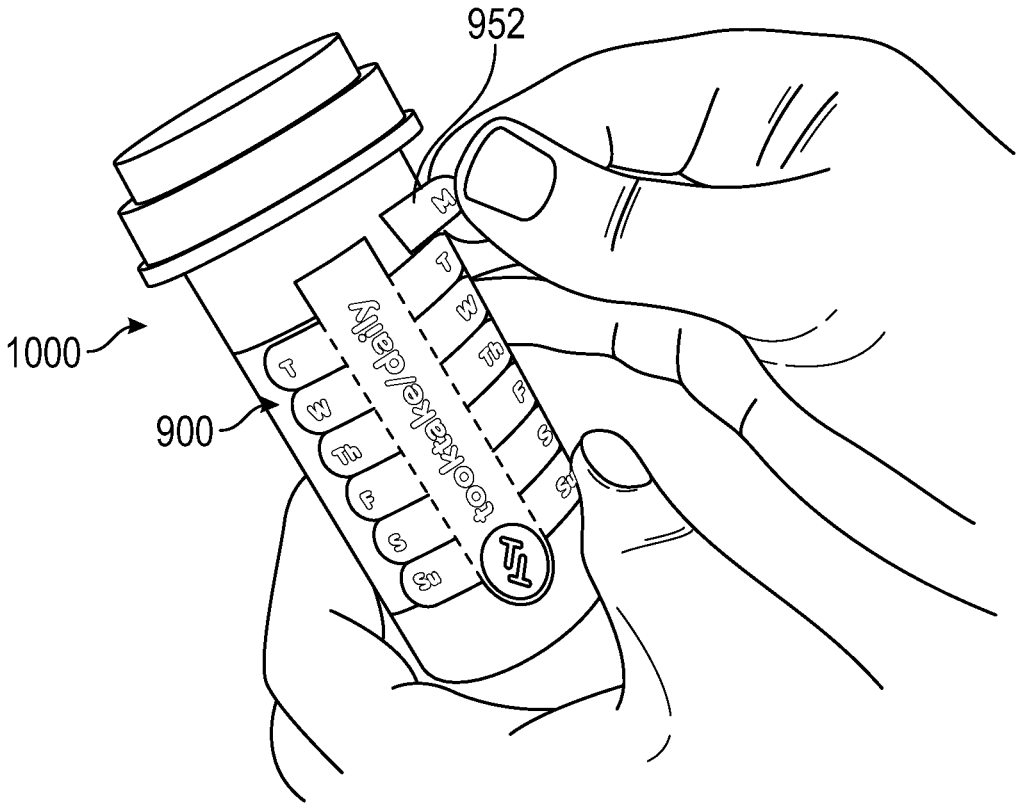

When the user consumes the medication at the regularly scheduled time, the user may peel a first tab 950 (e.g., as shown in FIG. 13D, the Monday tab) from the container 1000 and tear the first tab 950 at the perforation between the tab 950 and the main body. The user may continue this process, peeling successive tabs at each scheduled dosage time (e.g., on Tuesday, Wednesday, Thursday, Friday, Saturday, and Sunday, in the proper order). When the user begins the next dosage cycle (e.g., a second week as in the context of FIG. 13), the user may peel a second tab 952 from the container 1000 and tear the second tab 952 at the perforation between the tab 952 and the main body. As previously described, the user may continue this process, peeling successive tabs at each scheduled dosage time (e.g., on Tuesday, Wednesday, Thursday, Friday, Saturday, and Sunday, in the proper order). When all tabs have been removed from the label 900, or when the medicine duration is complete, or both, the user may remove the remaining portions of the label 900 from the container 1000. The remaining portions of the label 900 may be discarded. The remaining portions of the label 900 may be solely the main body or may be the main body and any remaining tabs not used during the scheduled course of the medication. If the container 1000 still has medicine in the bottle and the course has not yet been complete, but the tabs on the label 900 have been completely removed, the user may remove the main body remaining on the container 1000. A user may then repeat steps of FIGS. 13A-13E with a new label until the next cycle (e.g., Monday-Sunday of two weeks) is complete.

Although shown and described with the user removing the upper most tab first, any tab on the label may be removed first. For example, the user may begin their course of medication on Thursday and thus remove the Th tab first. Although shown with the user removing a tab on the left of the main body first, a tab on the right of the main body may be removed first.

The labels 100, 200, 300, 400, and/or 600 may be single-layer, removable dosage tracking labels having a single-layer main body and one or more single-layer tabs coupled to the single-layer main body. The single-layer, removable dosage tracking label is configured for use with a container having items with a dosage requirement. The one or more single-layer tabs corresponds to the dosage requirement. The items with a dosage requirement are pills, tablets, medication, supplements, or vitamins. The one or more single-layer tabs include an indicator corresponding to the dosage requirement. The one or more single-layer tabs are configured for removal from the single-layer main body, and wherein the one or more single-layer tabs are configured to track dosage of the item in the container.

Although shown with tabs on both sides of a main body, the tabs may be on one side, two sides, three sides, or more sides. For example, where the main body is longitudinal as in the described examples, tabs may be provided on only one side of the main body. In an example, the main body may be a circle, a square, a star, or other polygonal shape. In that case, the tabs may be placed on any combination of sides, a single side, all sides, etc.

Although shown with the same dosage course and the same number of tabs on both sides of the main body, the information on the tabs may be different. For example, the tabs provided on one side may be for a 7-10 day course and the tabs on the other side may be for a Monday-Sunday course.

Accordingly, the label of the present disclosure allows a consumer to simply and economically remember to take their medication and/or supplements. The label of the present disclosure is designed to adjust to the consumers prescription needs instead of being set or constrained to a calendar system. The label assists consumers who do not frequently take medication and have a short term prescription to remember to take the prescribed medication. The label may also help caregivers and elderly consumers to remember to take the prescribed medication. The label may be a reminder to visually impaired persons or those unable to read the visual cues. For example, the label may be tactile, that is, the label may have depressions, protrusions, braille, or other imprinted symbols, shapes or letters, such that any user may feel the tab to confirm dosage and remove the tab. Alternatively, the tab itself may be the tactile portion such that a user may simply feel the tab and know a dosage is to be taken.

The label of the present disclosure may be simply placed on the bottle with a temporary adhesive. The consumer tears off the tab as the dosage of the medicine and/or supplement is taken. When the course of the medicine and/or supplement is completed, the remaining portions of the label may be removed and thrown away. Alternatively, if all tabs of the label are removed and there are still more dosages of the medicine to be take, the main body of the label may be removed and thrown away and a new label complete with tabs may be placed on the bottle. This may be repeated as necessary until the course of the medicine and/or supplements are completed.

Additionally, the label of the present disclosure is adhesive and may include adhesive tabs. The adhesive tabs may allow for the tabs to remain secured to the bottle. Thus, if the bottle is placed in a bag for travel or rubs against another bottle, a container, a shirt, etc., the tabs may remain on the bottle without getting caught up and falling off of the bottle. The label of the present disclosure is designed to accommodate any shape and/or size of medication and/or supplement container. This may include, for example, a liquid bottle (e.g. cough syrup), a blister pack, table medicine container or bottle, supplement container or bottle, or other container.

Although the foregoing description is directed to the preferred embodiments of the invention, it is noted that other variations and modifications will be apparent to those skilled in the art and may be made without departing from the spirit or scope of the invention. Moreover, features described in connection with one embodiment of the invention may be used in conjunction with other embodiments, even if not explicitly stated above.

The invention claimed is:

1. A single-layer, removable label comprising:

a main body having a central longitudinal axis;

at least one first tab on a first side of the central longitudinal axis;

at least one second tab on a second side of the central longitudinal axis; and an adhesive applied to a rear side of the main body and a rear side of each of the at least one first tab and the at least one second tab, wherein the adhesive is a low-tack, pressure-sensitive adhesive, wherein the first side and the second side are opposing sides of the central longitudinal axis.

2. The single-layer, removable label of claim 1, wherein the adhesive is applied directly to the rear side of the main body and the rear side of each of the at least one first tab and the at least one second tab.

3. The single-layer, removable label of claim 1, wherein the adhesive allows the single-layer, removable label to be removable, repositionable, reuseable, readherable, or relocatable, or combinations thereof.

4. The single-layer, removable label of claim 1, wherein the adhesive is applied to an entirety of the rear side of the main body and an entirety of the rear side of each of the at least one first tab and the at least one second tab.

5. The single-layer, removable label of claim 1, wherein the at least one first tab comprises a plurality of first tabs and the at least one second tab comprises a plurality of second tabs.

6. The single-layer, removable label of claim 5, wherein a number of the plurality of first tabs is equal to a number of the plurality of second tabs.

7. The single-layer, removable label of claim 5, wherein the plurality of first tabs and the plurality of second tabs are located along an entirety of a length of the main body.

8. The single-layer, removable label of claim 5, wherein each of the plurality of first tabs is separated from an adjacent tab of the plurality of first tabs with a first detachable connection and wherein each of the plurality of first tabs is separated from the main body with a second detachable connection.

9. The single-layer, removable label of claim 8, wherein the first detachable connection is a die cut and the second detachable connection is a perforation.

10. The single-layer, removable label of claim 8, wherein each of the plurality of second tabs is separated from an adjacent tab of the plurality of second tabs with a third detachable connection and wherein each of the plurality of second tabs is separated from the main body with a fourth detachable connection.

11. The single-layer, removable label of claim 10, wherein the first detachable connection and the third detachable connection are each a die cut.

12. The single-layer, removable label of claim 10, wherein the second detachable connection and the fourth detachable connection are each a perforation.

13. The single-layer, removable label of claim 1, further comprising one or more indicators printed on a front side of the main body and the front side of each of the at least one first tab and the at least one second tab.

14. The single-layer, removable label of claim 13, wherein the one or more indicators corresponds to a predetermined dosage schedule.

15. The single-layer, removable label of claim 14, wherein the predetermined dosage schedule is 7-10 days, daily, a number of predetermined hours, or a number of predetermined times per day.

16. A single-layer, removable label comprising:

a main body having a central longitudinal axis;

a first subset of tabs on a first side of the central longitudinal axis, the first subset of tabs comprising a plurality of first tabs;

a second subset of tabs on a second side of the central longitudinal axis, the second subset of tabs comprising a plurality of second tabs, wherein the first side is opposite the second side about the central longitudinal axis;

a low-tack, pressure-sensitive adhesive applied to a rear side of the main body, a rear side of the plurality of first tabs, and a rear side of the plurality of second tabs; and one or more indicators disposed on a front side of the main body and a front side of the plurality of first tabs, and a front side of the plurality of second tabs, wherein the plurality of first tabs are separated from the main body with a first detachable connection, the plurality of second tabs are separated from the main body with a second detachable connection, and wherein each of the plurality of first tabs are separated from adjacent tabs of the plurality of first tabs with a third detachable connection and each of the plurality of second tabs are separated from adjacent tabs of the plurality of second tabs with a fourth detachable connection.

17. The single-layer, removable label of claim 16, wherein the main body includes a rectangular portion and a semicircular portion and wherein each of the tabs of the plurality of first tabs and the plurality of second tabs includes a rectangular portion and a rounded portion.

18. The single-layer, removable label of claim 16, wherein each of the first detachable connection and the second detachable connection are perforations and wherein each of the third detachable connection, and the fourth detachable connection are die cut.

19. The single-layer, removable label of claim 16, wherein the low-tack, pressure-sensitive adhesive allows the single-layer, removable label to be removable, repositionable, reuseable, readherable, or relocatable, or combinations thereof and is configured to leave no residue on an exterior surface to which the single-layer, removable label is secured.

20. The single-layer, removable label of claim 16, wherein the one or more indicators are printed, embossed, or imprinted on the front side.

21. A single-layer, removable dosage tracking label comprising:

a single-layer main body; and one or more single-layer tabs coupled to the single-layer main body, wherein the single-layer, removable dosage tracking label is configured to be adhered by an adhesive to a container having items with a dosage requirement, and wherein the one or more single-layer tabs corresponds to the dosage requirement.

22. The single-layer, removable dosage tracking label of claim 21, wherein the items with a dosage requirement are pills, tablets, medication, supplements, or vitamins.

23. The single-layer, removable dosage tracking label of claim 21, wherein the one or more single-layer tabs include an indicator corresponding to the dosage requirement.

24. The single-layer, removable dosage tracking label of claim 21, wherein the one or more single-layer tabs are configured for removal from the single-layer main body, and wherein the one or more single-layer tabs are configured to track dosage of the item in the container.

25. The single-layer, removable dosage tracking label of claim 21, wherein the adhesive is a low-tack, pressure-sensitive adhesive.

26. A single-layer, removable label comprising:

a main body having a central longitudinal axis;

at least one first tab on a first side of the central longitudinal axis;

at least one second tab on a second side of the central longitudinal axis; and an adhesive applied to a rear side of the main body and a rear side of each of the at least one first tab and the at least one second tab, wherein the first side and the second side are opposing sides of the central longitudinal axis, wherein the at least one first tab comprises a plurality of first tabs and the at least one second tab comprises a plurality of second tabs.

* * * * *